United States Patent [19]

Kawai et al.

[11] 4,401,391

[45] Aug. 30, 1983

[54] SERIAL PRINTER

[75] Inventors: Jun Kawai, Hirakata; Akira Katsura, Amagasaki, both of Japan

[73] Assignee: Matsushita Electric Industrial Co., Ltd., Kadoma, Japan

[21] Appl. No.: 257,133

[22] Filed: Apr. 24, 1981

[30] Foreign Application Priority Data

| | | | |
|---|---|---|---|
| Apr. 28, 1980 | [JP] | Japan | 55-56863 |
| Apr. 28, 1980 | [JP] | Japan | 55-58999[U] |
| May 2, 1980 | [JP] | Japan | 55-61099[U] |
| May 2, 1980 | [JP] | Japan | 55-61100[U] |
| May 2, 1980 | [JP] | Japan | 55-61101[U] |
| May 2, 1980 | [JP] | Japan | 55-61102[U] |

[51] Int. Cl.[3] ..... B41J 3/04

[52] U.S. Cl. ..... 400/120; 346/76 R; 101/93.04

[58] Field of Search ..... 400/120, 124, 320; 346/76 R, 76 PH; 101/93.04, 320

[56] References Cited

U.S. PATENT DOCUMENTS

| | | | |
|---|---|---|---|
| 3,845,850 | 11/1974 | Herr et al. | 400/120 |
| 3,848,720 | 11/1974 | Carlsen | 400/120 |
| 3,929,215 | 12/1975 | Hayakawa | 400/120 X |
| 3,934,698 | 1/1976 | McGourty | 400/120 X |
| 3,955,663 | 5/1976 | Ecker | 400/120 X |
| 4,173,273 | 11/1979 | Hanakata | 400/120 |
| 4,225,251 | 9/1980 | Klimek et al. | 400/120 X |
| 4,297,039 | 10/1981 | Lees | 400/120 |
| 4,300,844 | 11/1981 | Keil | 400/120 |

*Primary Examiner*—Edward M. Coven

*Attorney, Agent, or Firm*—Cushman, Darby & Cushman

[57] ABSTRACT

In a serial printer, a thermal printing head is mounted on a printing head holder which in turn is mounted for movement across the width of the paper and wherein a spring force is utilized to press the printing head onto the paper; a lever mounted on a lever pin is connnected to the printing head and the lever cooperates with two cam elements and a cam surface located at selected points of travel of the printing head whereby the printing head will be removed from or engaged with the paper when it reaches a limit of travel and will remain out of contact with the paper while the paper is advanced to the next printing position.

12 Claims, 17 Drawing Figures

SERIAL PRINTER

BACKGROUND OF THE INVENTION

1. Field of the Invention

The present invention relates to a small size serial printer for use, for example, small calculator, measuring equipment or electronic translator of pocket size.

2. Description of the Prior Art

Recently, electronic apparatuses provided with printer, for example printer-equipped pocket size calculators, become smaller and smaller. For such small sized electronics apparatuses with printers, there are strong demands to decrease the size of the printer and to decrease the size and power of the power sources. Furthermore, in order to decrease price of the printers, simplicity of the structure and decrease of number of components are also required.

For the abovementioned printers, serial printers of thermal printing type or discharge printing type have been widely used. In such serial printers, printing head is pressed on a recording paper by means of a spring pressure and the head is driven to sweep widthwide of the oblong recording paper for printing, and then at a completion of one line printing the paper is driven or transferred lengthwise. In order to reduce the friction force against the transferring of the paper, it has been general to carry out to remove the printing head away from the paper face. However, for the small sized electronic apparatus, the problem is that the load of transferring the paper and the load of moving away of the head are simultaneously impressed on a small motor, and therefore an extremely small motor can not be used. Furthermore, the conventional apparatus has comprised a considerable number of mechanical components thereby hampering decreasing of the size and thickness of the printer.

SUMMARY OF THE INVENTION

The present invention proposes to provide a small size serial printer for pocket type apparatuses which can be operated with a smaller power and constructed by less number of components.

BRIEF EXPLANATION OF THE DRAWINGS

FIG. 13(*b*) is a schematical elevation view of the parts shown in FIG. 13(*a*).

FIG. 13(*c*) is a perspective view of the head holder 7 and related part.

DESCRIPTION OF THE PREFERRED EMBODIMENT

The present invention is elucidated hereinafter in detail referring to the accompanying drawings which show preferred example embodying the present invention.

(1) General configuration

Figure 1:
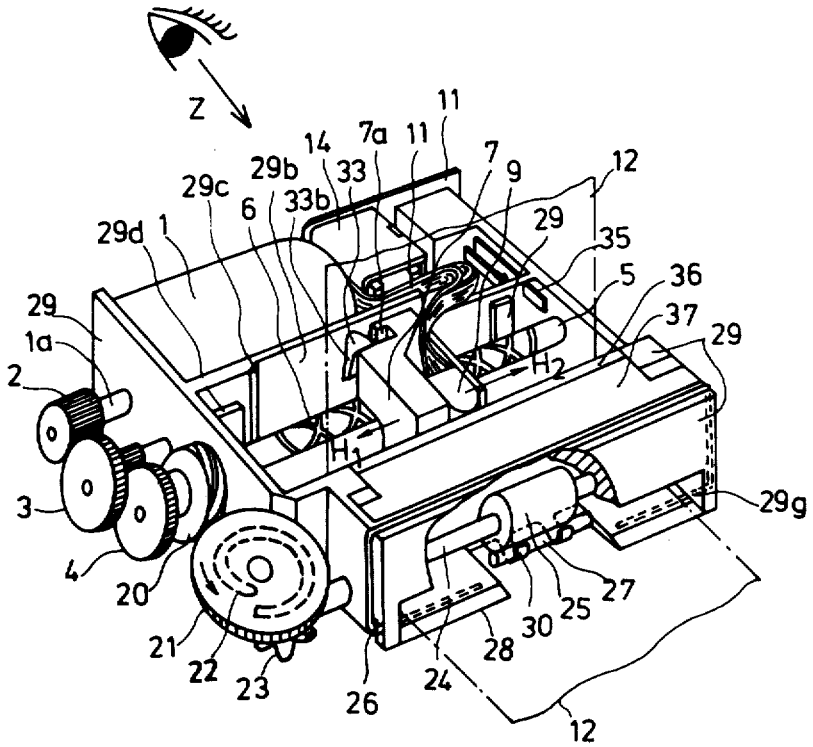
FIG. 1 is a perspective view of a serial printer embodying the present invention.

FIG. 1 which shows overall configuration of the example, a box-like frame 29 comprises therein an electric motor 1, a synchronizing pulse generator 14, a head holder 7 having a head 9 thereon, a head holder driving shaft 5 and a paper driving roller 25. Revolving power of the motor 1 is transmitted through a motor shaft 1*a*, a pinion 2 fixed on the motor shaft 1*a* and an idler gear 3, to the driving shaft gear 4 which is fixed on the driving shaft 5. The driving shaft 5 has a loopcoiled groove 6 which comprises two oppositely coiled grooves end parts of which are connected with a smoothly curved groove thereby forming a groove of a twisted closed loop. A slider 8 (in FIG. 2) having a sliding edge 81 of a predetermined length is provided in a manner that the sliding edge 81 slides along in the groove 6 thereby tracing the closed loop groove 6 and hence driving the slider 8 reciprocatingly in the directions of arrows $H_1$ and $H_2$ along the driving shaft 5, as the driving shaft 5 is continuously turned by meamns of the gear 4. The slider 8 is mounted on the head holder 7, and the head holder 7 is slidably held by a sliding guide rod 34, and hence it is reciprocatingly driven along the sliding guide rod 34 by the rotation of the driving shaft 5. The printing head 9 prints numerals or characters on a recording paper 12 backed by a pad 36, so that the user can observe the printed characters from the direction Z.

Figure 2:
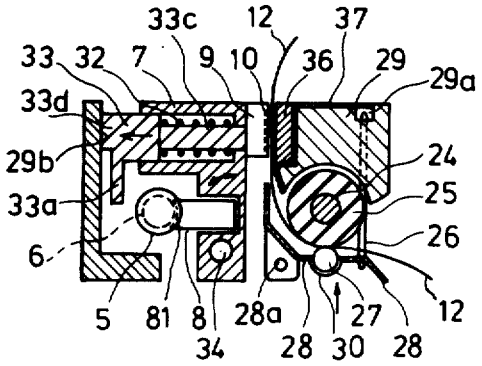
FIG. 2 is a sectional view of the front part taken at the center part of the head holder 7.
Figure 3:
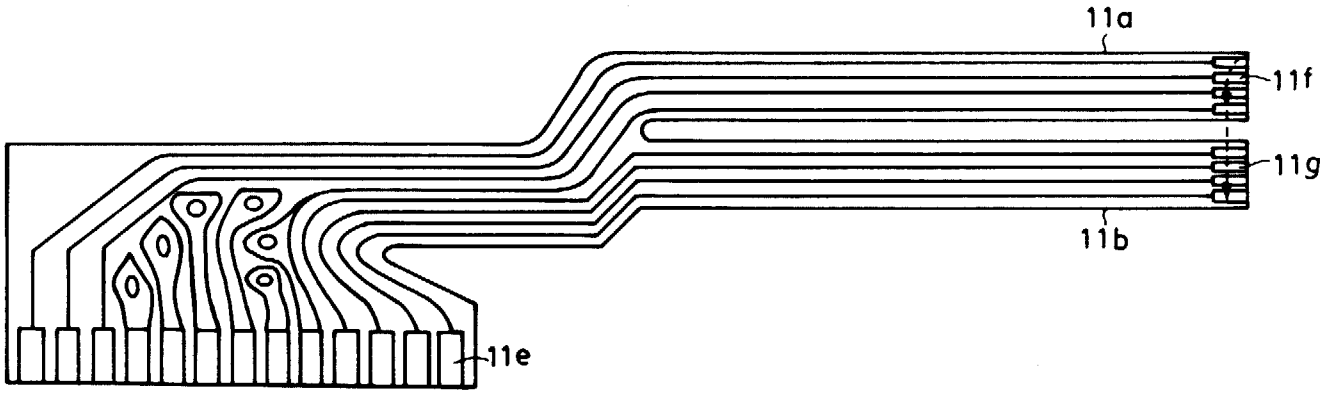
FIG. 3 is a unfolded view of a flat cable 11 to be connected to a printing head and other components.
Figure 4:
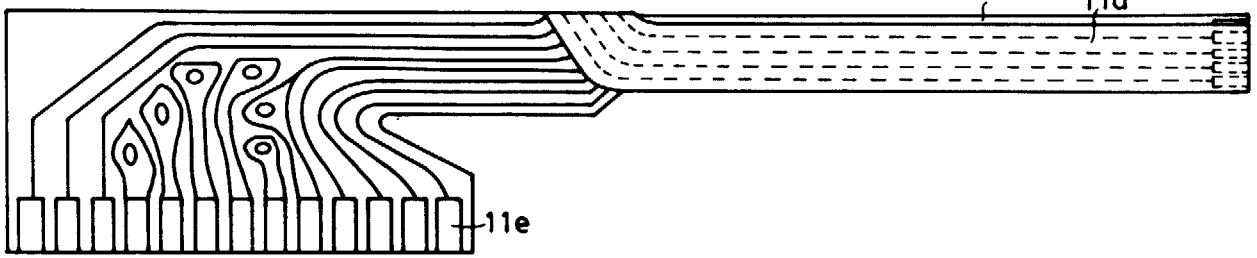
FIG. 4 is a view of the flat cable 11 in a folded shape for connection in the apparatus.

As shown in FIG. 2, the printing head 9 has a number of heating elements 10 disposed in vertical line on its front face and the heating elements are selectively heated by currents supplied through a flat cable 11. The flat cable 11 are constructed in split type flat cable as shown in FIG. 3 and is put with their faces parallel to each other as shown in FIG. 4 and FIG. 1 in order to decrease width thereof. One end of the double flat cable is connected to the terminal leads 13 of the head 9 and a suitable part thereof is fixed on the rear end face of the motor 1 keeping a sufficient length of the cable therebetween in order to allow easy movement of the head 9 along the driving shaft 5. By adoption of the abovementioned parallel-disposed double flat cable, the width of the cable can be halved to about 4 mm from the conventional case using a single link flat cable.

(2) The pulse generator 14

Figure 5:
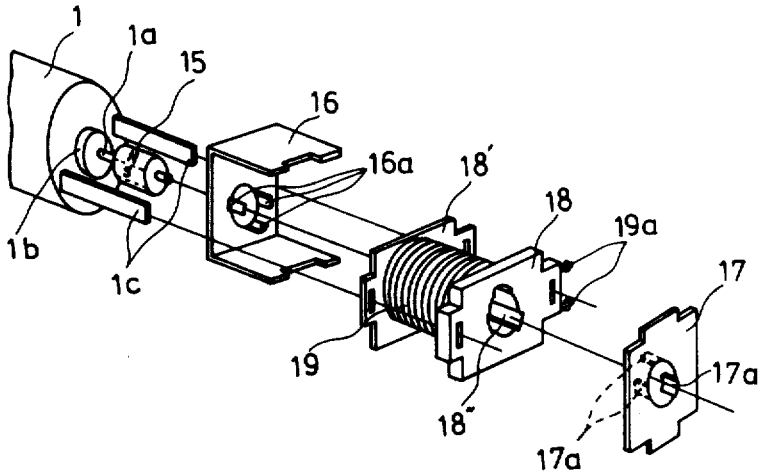
FIG. 5 is an exploded perspective view of a pulse generator 14.
Figure 6:
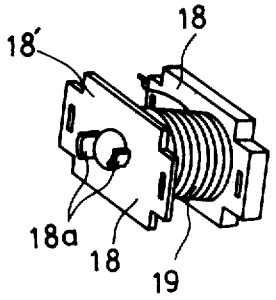
FIG. 6 is a perspective view of a coil 19 and a coil bobbin 18 of the pulse generator 14 of FIG. 5.

The pulse generator 14 disposed at the back of the motor 1 is constituted as illustrated in FIG. 5, wherein a permanent magnet 15 is mounted on the rear end of the motor shaft 1*a*. The permanent magnet 15 has several poles disposed around its cylindrical face. Central part of a U-shaped yoke 16 and an end plate 17 to be connected to the end part of the yoke 16 have several pole pieces 16*a* and 17*a* provided by bending strip shaped torn parts of the yoke 16 and the plate 17, respectively. A bobbin 18 having a coil 19 is disposed in the space formed by the U-shaped yoke 16 and the end plate 17, and the pole pieces 16*a* and 17*a* are inserted in a through hole 18 of the bobbin 18. The pole pieces 16*a* and 17*a* are provided in a manner that when one kind poles of the permanent magnet 15 faces the pole piece 16*a* then the opposite kind poles of the permanent magnet 15 faces the other pole pieces 17*a*. The bobbin 18 has engaging projections 18*a* (in FIG. 6) which engage around the bearing 1*b* of the motor 1, and fixing tabs 1*c* are received in the holes of the bobbin 18 and calked thereon thereby to fix the yoke 16, the bobbin 18 and the end plate 17 to the motor 1 in an accurate coaxial relation to each other.

(3) Operation of the pulse generator 14

Figure 7:
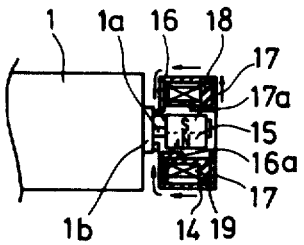
FIG. 7 and FIG. 8 are fragmental sectional views of the pulse generator 14 for explaining operation thereof.
Figure 8:
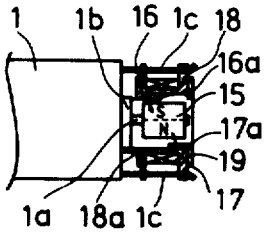

When the pole pieces 16*a* face N-poles of the permanent magnet 15, then the pole pieces 17*a* face S poles. Therefore, the magnetic flux flows from N-poles, through the pole pieces 16*a*, the yoke 16, the end plate 17 and the pole pieces 17*a* to the S-poles as shown by FIG. 7. As the motor 1 rotates the relation between the pole pieces 16*a* and 17*a* and magnetic poles are reversed as shown by FIG. 8, and in this period the magnetic flux decreases and become inversed. As a result of repetition of such rotation, an alternate current is induced at the terminal 19*a* of the coil 19, and the frequency of the alternate current is in synchronous with the revolution of the motor 1. Since the head holder 7 is driven reciprocally by the rotation of the motor 1 and the rotation of the same motor 1 make the pulse generator 14 issue pulse, the output pulse of the pulse generator 14 is in synchronous with the reciprocating motion of the head 9.

(4) Paper driving part 21–30:

The paper driving part comprises the components 21–30. A flat worm gear 20 is mounted on a part of the driving shaft 5, and a worm wheel 21 engages with the worm gear 20. The worm wheel 21 has on its lower face a snail-cam projection, namely a snail cam 22. A cam gear 23 mounted on a paper driving shaft 24 is disposed to engage the snail cam 22. The driving shaft 24 has a rubber roller 25. A guide plate 28 is hinge-held by a pin 28*a* which is fixed on the lower part of the frame 29, and held upwards by means of open-ends of a wire spring 26 which open ends disposed under the guide plate 28 push the bottom part thereof upwards. The guide plate 28 has receiving tabs 30 at the lower center part thereof, and the receiving tabs 30 receive a pinch roller 27 which contacts the lower part of the rubber roller 25, so that a recording paper is inserted inbetween and driven by the rubber roller 25 as its shaft 24 is driven by means of rotation of the cam gear 23.

(5) Operation of the paper driving part

Figure 9:
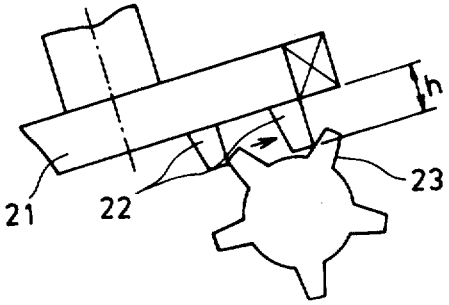
FIG. 9 is a sectional side view of a worm wheel 21 and a snail cam 22 and a cam gear 23.
Figure 10:
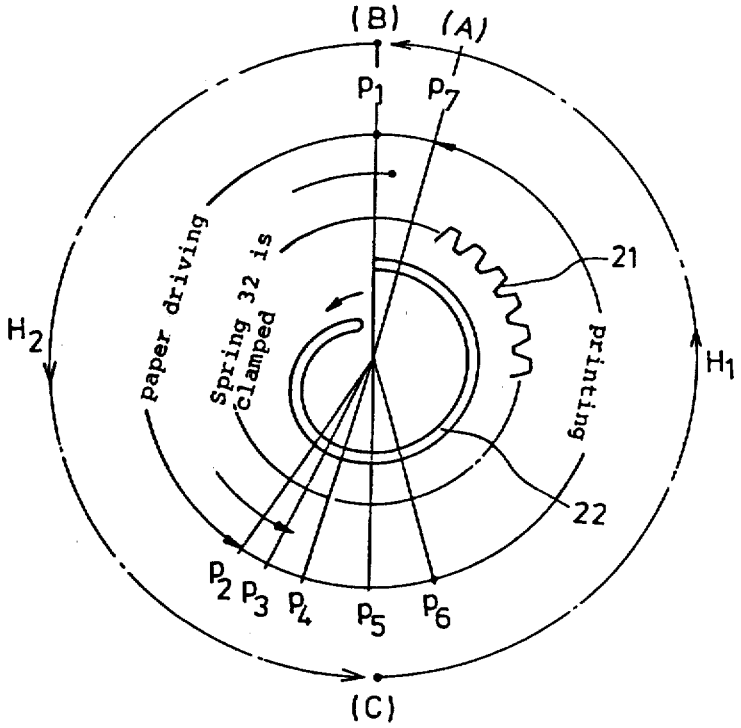
FIG. 10 is a timing phase chart showing relation between rotation of a worm wheel 21, motion of a paper driving roller 25, operation of a printing head 9, motion of a lever pin 33*a*, spring 32 and other related components.

When the motor rotates, the head 9 reciprocatingly moves in the directions shown by the arrows $H_1$ and $H_2$ by means of rotation of the driving shaft 5, and at the same time, the worm wheel 21 is driven by the rotation of the worm gear 20. Thereby, the snail cam 22 under the worm wheel 21 intermittently drives the gear cam 23. The gear ratio of the worm gear 20 and the worm wheel 21 is selected in such a manner that the worm wheel 21 turns for 360° during the period while the head holder 7 makes one period of reciprocating motion along the sliding guide rod 34. The motion of the cam gear 23 is limited only to the period of during 180° turning of the worm wheel 21, by means of the pattern of the snail cam 22, since the snail cam changes its radial displacement for the 180° turning only. In order to smoothly turn the cam gear 23 without backlash, the snail cam 22 is designed so as to have taller height h at the outer part than the inside part as shown in FIG. 9. The paper driving, the motion of the printing head and other related motions of the serial printer in relation to the angular position of the engaging of the snail cam 22 and the cam gear 23 is schematically shown in FIG. 10, wherein in the one cycle period of the reciprocating motion of the head 9, i.e. on cycle period of the worm wheel 21, a period $p_1$ to $p_2$ of about 120° of one turn is used for gradual driving of paper by driving the rubber roller 25 for shifting line of printing on the paper, and for the balance of the period, namely $p_2$ to $p_1$, the paper is not driven wherein printing is made in a period of $p_6$ to $p_7$.

Figure 11:
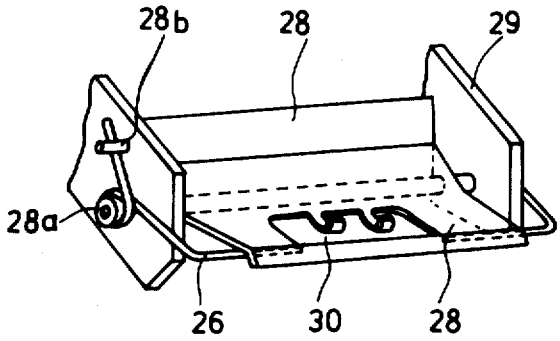
FIG. 11 and FIG. 12 are perspective views of paper guiding plates 28 and related parts of frames 29 of other examples than FIG. 1.
Figure 12:
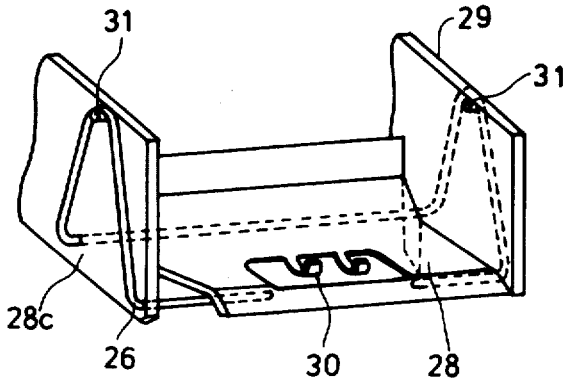

FIG. 11 and FIG. 12 show other examples of the spring 26 to push the guide plate 28 upwards. In FIG. 11, the spring 26 is held by the pin 28*a* and a pin 28*b*, and in FIG. 12, the spring 26 is held by a hole 28*c* and pins 31.

Figure 13A:
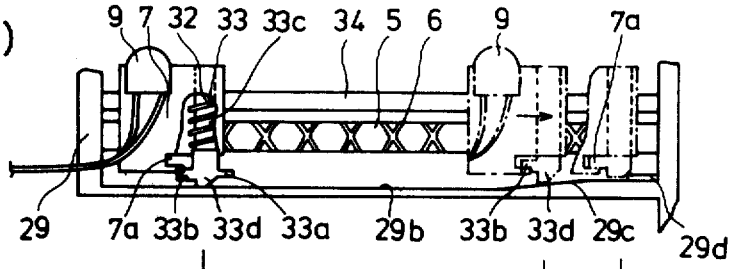
FIG. 13(*a*) is a schematical plan view of a head holder 7, a printing head 9, the lever pin 33, cams 29*d* and 29*e* and related parts for explaining motion of the lever pin 33 and the head holder 7.
Figure 13:
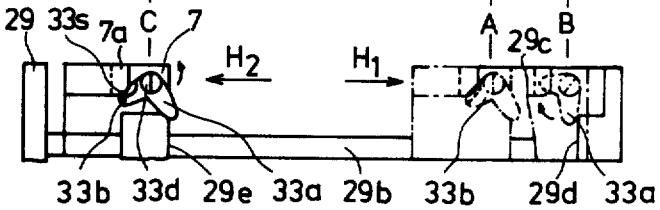
Figure 13:
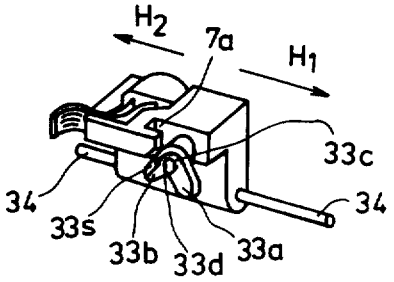

(6) Head spring controlling device 29*e*, 29*d*, 32, 33 7*a*:

One of the important feature of the present invention lies in the novel structure of the head spring controlling device shown in FIG. 2 and in FIGS. 13(*a*), 13(*b*) and 13(*c*), which comprises head spring 32, a lever pin 33 comprising wings 33*a* and 33*b* and a pin 33*c* with the head spring 32 around it, and a lever catching recess 7*a* in the head holder 7 and further comprises projections 29*d* and 29*e* (FIG. 13(*b*)) disposed at both end parts of the moving range of the head holder 7. The head spring 32 is to give a force to press the pin lever 33 against a wall 29*b* in the frame 29, so as to give abutting force to the head holder 7 held on the sliding guide rod 34 towards a paper 12 (shown in FIG. 2). The paper 12 is led from the lower opening 29*g*, pinched between the rubber roller 25 and the metal pinch roller 27, led upwards, and is supported at its rear face by a pad 36 of rubber or the like elastic material. By means of the spring force, the head 9 is pressed to the paper 12, so that known small heaters vertically disposed on the head 9 are pressed on the paper face with an appropriate pressure. The lever 33*b* of the lever pin 33 has a knife-edge-like sloped or tapered face 33*s*, (FIGS. 13(*b*) and 13(*c*)) in order that the lever 33*b* can easily enter the slot 7*a* in the head holder 7 when slightly pushed towards the tip of the pin 33*c* and at the same time the lever 33*a* is pushed. On the wall 29*b*, at both end parts of the moving stroke of the head holder 9, a first projection 29*d* and a second projection 29*e* are provided, and near the first projection a tapered wall part 29*c* is also provided.

(7) Operation of the head spring controlling device:

When the head holder 7 travels in the direction shown by an arrow $H_1$, the center projection 33*d* of the lever pin 33 slides on the sloped part 29*c* passing the position A, and hence the lever pin 33 is slightly pushed into the head holder 7, so that the lever pin 33*b* is pushed to the position easily to enter the slot 7*a*. And then, when the center of the lever pin 33 comes to the position B the lever 33*a* touches the first projection 29*d*, and therefore is turned clockwise as shown in FIG. 13(*b*), accordingly, the lever pin 33*b* enters in the slot 7*a* and retained there. Then the head-holder 7 travels back to the direction shown by the arrow $H_2$. In almost all of this travelling in the $H_2$ direction, the lever 33*b* is retained engaging in the slot 7*a*, and therefore the spring 32 is clamped, and the spring force is deenergized or intercepted from pressing the head 9 on the recording paper. Accordingly, during the travelling in the $H_2$ direction, the head 9 is released from pressing to the paper 12. When the center of the lever pin 33 comes to the position C, then the lever 33*a* touches the projection 29*e* and hence the lever pin 33 turns counterclockwise as shown in FIG. 13(*b*), thereby releasing the lever 33*s* from the slot 7*a* and restores the lever pin 33 to press the wall 29*b* by its center projection 33*d*. Therefore, the spring 32 becomes in the state of pressing the paper by the head 9. Then, the head holder 7 reverses its direction of travelling to $H_1$ and travels to the position A and further to the position B. In this travelling in $H_1$ direction the spring 32 performs to press the head 9 to the recording paper 12.

(8) Relative operation of the worm wheel 21, paper driving roller 25 and the head spring controlling apparatus The relative operation of the engagement position between the snail cam 22 of the worm wheel 21, paper driving roller 25 and the apparatus to control the head spring 32 is elucidated referring to the phase chart schematically illustrating the phase or timing of the operations thereof as shown in FIG. 10.

The apparatus is resting in the phase $p_3$ where the lever 33*b* is clamped in the slot 7*a* thereby preventing pressing of paper 12 by the head 9. When a signal ordering the printer is input, the motor 1 starts rotation from the resting phase $p_3$ which corresponds slightly before the position C. And after the head holder 7 slightly travels in $H_2$ direction, the clamping of the lever 33*b* in the slot is released at the phase of $p_4$ and the head 7 restores to press the paper 12 and the limit switch 35 is actuated. Immediately thereafter, and the head holder 7 comes to the position C, where the travel direction is reversed at the phase $p_5$ to the $H_1$ direction. By the actuation of the limit switch 35, a pulse signal from the pulse generator 14 is led to a control circuit, and at the phase $p_6$ when a predetermined number of pulses are sent to the circuit, and where the head 9 is slightly apart from the position C, the printing head 9 starts printing and the printing process continues to the phase of $p_7$. At the phase $p_7$, where the lever pin 33 comes to the position A, the printing stops and the clamping of the spring 32 starts. Then at the phase $p_1$, which corresponds to the position B where the spring is clamped, the head travelling direction is reversed, and at the same time the paper driving starts under releasing of the head pressure on the paper 12. The paper driving continues from the phase $p_1$ to the phase $p_2$, which is slightly before the resting position. At the phase $p_2$, when necessary printing is over, a braking signal is impressed on the motor 1, and therefore after a very short time the motor stops at the phase $p_3$. When printing is ordered successively for two lines or more on the paper 12, then the stop signal is not given at the phase $p_2$, and therefore the process continuously advances passing $p_3$ to $p_4$ and thereafter.

As is elucidated in detail, the head spring control apparatus in accordance with the present invention enables releasing of the pressing force of the head spring 32, by a simple motion of lever pin 33 to clamp the spring force conveying protrusion 33*d* during the time period of driving the recording paper 12 for line shifting. And an important feature of the operation is that the clamping is made by utilizing stroking or travelling of the head and that during clamped state there is no power consumption for clamping as such since no holding-electromagnet or the like power-consuming component is used. Therefore, by selecting the phase of the clamping operation and release of clamping operation outside the paper driving period, the maximum motor power and maximum power consumption are limited low, thereby enabling use of a fairly small motor and a small power source. Besides, components used for the clamping of the head spring are very simple and cheap, the apparatus can be economically provided.

(9) Pad angle adjustment device 36 37

Figure 14:
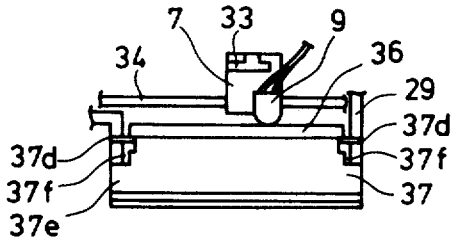
FIG. 14 is a plan view showing a paper pad 36 and a paper pad base 37.
Figure 15:
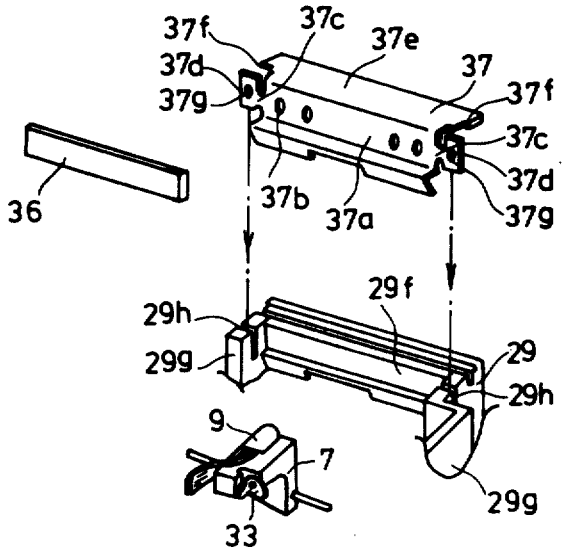
FIG. 15 is an exploded perspective view showing the paper pad 36, the paper pad base 37, related part of the frame 29 and related components thereto.

In order to obtain good printing, the pad 36 to back the recording paper 12 against the printing head 9 should have been mounted with suitable angle. Accordingly, the example shown by FIG. 14 and FIG. 15 afford a simple-structured pad angle adjustment device which can be easily adjusted. The pad 36 of rubber or the like elastic material is bonded on a pad holder 37, which comprises vertical pad-bonding face 37*a* having several holes 37*h*, horizontally bent part 37*e* and engaging tabs 37*d* formed at the side tips of the pad-bonding face 37*a* with narrow channel parts 37*c* inbetween. The pad holder 37 is mounted on the frame 29 by inserting the engaging tabs 37*d* into slits 29*h*. The pad holder 37 has small recesses 37*f* on the horizontally bent part 37*e*. The pad 36 is bonded on the pad bonding face 37*a* with a suitable bond. It is preferable to form press formed protrusions 37*g* of a hemispherical shape, or a suitable shape, on the engaging tabs 37*d*, so that the protrusions 37*g* afford good fixing in the slits 29*h*. The holes 37*h* on the pad-bonding part 37*a* serves to ensure stronger bonding force by instrusion of bond layers in the holes.

The adjustment of the pad angle is carried out by inserting some tool such as a small screw driver or small fork shape tool in the recess 37*f* and plying it.

By embodying the present invention, the abovementioned miniature size thermal serial type serial printers are successfully manufactured and very stable operations are obtained. Their typical technical data are as follows:

| | |
|---|---|
| width | 62 mm |
| depth | 49 mm |
| height | 12 mm |
| weight | 45 gr. |
| width of paper | 38 mm |
| maximum input power | 2,000 mW |
| printing speed | 1.5 lines (× 15 letters)/sec, (= 22.5 letters/sec) |

What is claimed is:

1. In a serial printer of the type including a frame means having a paper moving means thereon for intermittently moving a recording paper relative to a printing position to bring a new part of the paper to said printing position, a head holder movably mounted on guide means disposed on said frame means, a motor and gear means for respectively driving said paper moving means and said head holder, said head holder supporting a printing head having a printing element which faces the recording paper in said printing position said printing head along a path of travel substantially widthwise of the recording paper traversing said printing position, said head holder having a head pressing means for pressing said head onto the surface of the recording paper at least during a period of printing and for releasing said head at least during the movement of the recording paper, the improvement comprising:

said head pressing means including a lever pin carried by said head holder and movable between a clamped and unclamped positions on said head holder, a pressing member mounted on said head holder for constantly urging said lever pin and printing head away from each other whereby an end of said lever pin engages a surface of said frame means and said printing head presses against the recording paper when said lever pin is in said unclamped position, locking means on said lever pin and head holder for locking said lever pin in said clamped position wherein said printing head stops pressing against the recording paper, first and second cam means mounted on said frame means, each at one end of the path of travel of said printing head, said first cam means being engageable by a portion of said lever pin to move said locking means to a locked position to thereby move said lever pin to said clamped position, said second cam means being engageable by said portion of said lever pin to release said locking means to thereby move said lever pin to said unclamped position.

2. A serial printer in accordance with claim 1, wherein said second cam means is disposed at a position where said lever pin lies at the start of a printing process and said first cam means is disposed at a position where said lever pin lies at the finish of the printing process.

3. A serial printer as claimed in claim 2 wherein the surface of said frame means engaged by said one end of said lever pin has at one end of said path of travel a sloping portion which, when engaged by said lever pin, moves said lever pin toward said clamped position.

4. A serial printer in accordance with claim 1, wherein said printing head has a row of heating elements forming a row of heating dots at the front face of said printing head, said row being in a lengthwise direction of said recording paper.

5. A serial printer in accordance with claim 1 wherein an operating circuit is provided and said printing head is connected to said operating circuit by means of a flat cable having a lengthwise slit along a portion thereof to permit folding of said cable into parallel leaves.

6. A serial printer as claimed in claim 1, wherein said motor gear means includes a work wheel mounted on said frame means and driven by a worm gear, also mounted on said frame means, said worm gear being drivingly connected to said motor, said work wheel drivingly engaging a cam gear mounted on a shaft supported in said frame means, said shaft having a roller mounted thereon for rotation with said shaft, said frame means including a paper guiding plate hingedly connected to said frame, said plate having means for rotatably holding a pinch roller in engagement with said roller.

7. A serial printer in accordance with claim 1, which further comprises a driving shaft driven by said motor and gear means and which has a closed loop of coil-shaped grooves into which a slider pin, held on said head holder, is slidably engaged thereby to drive said head holder widthwise of the recording paper by means of revolving of said driving shaft.

8. The serial printer as claimed in claim 1 wherein said paper moving means comprises a driven roller of elastic material mounted on a shaft rotatable by said motor, a paper guiding plate extending generally transverse to said shaft in the vicinity of said driven roller, said guiding plate having a pinch roller supporting portion, the pinch roller supported in said pinch roller supporting portion and spring means for biasing said pinch roller against said driven roller.

9. The serial printer as claimed in claim 1 further including a pad for backing the recording paper, said pad being mounted on a pad base, means for mounting said pad base on said frame means, said mounting means including means for adjusting the angle that said pad base makes with said printing head.

10. A serial printer in accordance with claim 1, which further comprises a pulse generator for producing timing signals for printing dots by said printing head, said pulse generator being connected to said motor thereby to make said timing signal in synchronism with rotation of said motor.

11. A serial printer in accordance with claim 10, wherein said pulse generator comprises a permanent magnet having magnetic poles on the periphery thereof and connected to a shaft of said motor, a stator yoke comprising a U-shaped part and flat part, both parts having pole pieces at central parts thereof formed by cut and bent strip parts disposed around said permanent magnet a coil wound around a coil bobbin disposed around said pole pieces in said yoke, said bobbin being fixed to said motor in coaxial relation by inserting strip shaped frames extending from a casing of said motor.

12. A serial printer comprising a frame means, a printing head holder a printing head carried by said head holder so as to be engageable with and releasable from recording paper carried by said serial printer, said head holder having a lever pin rotatably mounted thereon, said lever pin having a recess therein for receiving a tapered tip located at the end of a first lever arm mounted on said lever pin, a second lever arm mounted on said lever pin and movable with said first lever arm, a compressible spring being mounted on said head holder and acting between said lever pin and said printing head, said frame means also having a wall including a sloped surface portion located adjacent one end of the path of travel of said head holder, said lever pin engaging said wall along its path of travel and being moved toward said printing head when said lever pin engages said sloped surface portion thereof so as to compress said spring acting between said lever pin and said printing head, said frame means having first and second cam members located, respectively, at opposite ends of said path of travel of said head holder and print head, said first cam means being located so as to engage said first lever arm to rotate said lever pin whereby said tapered tip will enter said recess on said head holder to clamp said spring and to thereby release said print head from the paper, said second cam member engaging said first lever arm at the opposite end of the travel of said head holder and printing head to move said tapered tip out of said recess to release said spring and press said printing head against said paper.

* * * * *